US005133478A

United States Patent [19]

Gordon

[11] Patent Number: 5,133,478

[45] Date of Patent: Jul. 28, 1992

[54] PILL DISPENSER

[75] Inventor: Steven L. Gordon, Beaverton, Oreg.

[73] Assignee: Alnamar Corporation, Beaverton, Oreg.

[21] Appl. No.: 550,910

[22] Filed: Jul. 6, 1990

[51] Int. Cl.[5] ..... G07F 11/06

[52] U.S. Cl. ..... 221/90; 221/69

[58] Field of Search ..... 221/2-3, 221/69, 82-83, 86, 89-90, 92, 123-124, 133, 86, 266

[56] References Cited

U.S. PATENT DOCUMENTS

| | | | |
|---|---|---|---|
| 1,984,893 | 12/1934 | Rinaldi | 221/87 |
| 3,057,473 | 10/1962 | Stern et al. | 221/92 |
| 3,278,010 | 10/1966 | Katz | 206/534 |
| 4,126,247 | 11/1978 | Majka | 221/91 |
| 4,572,403 | 2/1986 | Benaroya | 221/15 |
| 4,717,042 | 1/1988 | McLaughlin | 221/3 |
| 4,785,969 | 11/1988 | McLaughlin | 221/86 |
| 4,838,453 | 6/1989 | Luckstead | 221/86 |

*Primary Examiner*—David H. Bollinger

*Attorney, Agent, or Firm*—William A. Birdwell & Associates

[57] ABSTRACT

A pill dispenser particularly adapted for use by the physically or mentally infirm. A plurality of containers are arranged in a matrix, each for receiving, storing and selectively releasing one or more pills. The columns of the matrix correspond to days of the week, while the rows of the matrix correspond to times of the day. The containers are housed in a box which may be placed on its back for loading the containers with pills, and mounted vertically for use in dispensing of the pills. A guide is associated with the containers for receiving the contents of the containers and guiding them to a predetermined outlet. A removable cover is placed over the containers, the cover having push buttons which selectively actuate the containers, the push buttons being identified by labels for day of the week and time of the day. A timer, and clock display may be integrated into the dispenser so as to provide an audio display and illuminate the particular push button corresponding to the medication to be taken at a particular day and time.

35 Claims, 4 Drawing Sheets

PILL DISPENSER

BACKGROUND OF THE INVENTION

This invention relates to devices for selectively dispensing medicines, particularly to devices that arrange combinations of pills in a predetermined order and allow them to be dispensed by physically or mentally infirm persons with minimal difficulty at appropriate times.

It is often the case that persons with great physical or mental infirmities, such as congenital deformities, upper extremity amputations, arthritis, or borderline mental functioning, have a need to take one or more medications several times a day each day of the week. The medications are typically oral medications taken in the form of a pill. Because of such physical infirmities, it is frequently difficult for such persons to manipulate medicine containers to extract the pills, to understand consistently which pills are to be taken in what combination and when they are to be taken, or even to remember to take the pills at all.

While a variety of different pill dispensers have previously been devised, none satisfactorily meets the needs of the physically or mentally infirm. For example, Majka U.S. Pat. No. 4,126,247 discloses a pill dispenser having pill containers arranged in a matrix, each container corresponding to a day of the month, but the pills are dispensed from multiple containers by a single mechanism actuated by rotating a key placed in a slot, which is a relatively complicated and difficult system for a physically infirm person to use.

Another approach to dispensing medication is represented by Barham British Patent No. 2,205,306 and Behl U.S. Pat. No. 4,473,884, which disclose electrically operated automatic medication dispensers, but are very complex technically, and intimidating and difficult to use by the physically infirm. A somewhat related device is discloned in Simon U.S. Pat. No. 4,660,991, which shows a device for storing an signaling the time for taking drugs.

McLaughlin U.S. Pat. No. 4,717,042; Fites U.S. Pat. No. 3,587,517; and Will U.S. Pat. No. 4,593,819 all disclose pill dispensers that arrange the pills in a matrix of containers, but do little to facilitate identification of which pills to take when or extraction of the pills from the containers in a way that would be convenient for the physically infirm.

Another approach to organizing pills in a matrix is represented by Katz U.S. Pat. No. 3,278,010, which employs individual dispensing elements and respective troughs. In this case the pills must be dispensed by twisting the dispensing elements, which would ordinarily be a difficult task for the physically infirm, and the pills are all dispensed at different locations However, it can be seen that there is a need for a pill dispensing device that not only organizes pills in an orderly and understandable way so that they can be dispensed at the appropriate time, but that is straightforward and easy for the physically or mentally infirm to operate.

SUMMARY OF THE INVENTION

The present invention overcomes many of the drawbacks of prior art pill dispensers and facilitates the timely dispensation of medication to the mentally and physically infirm. It does so by providing a matrix of pill containers, arranged in rows and columns so that the rows represent times of day and the columns represent days of the week, and a simple means of releasing the contents of those containers, i.e., pills, so as to arrive at a single outlet. The containers are preferably in the form of troughs mounted by hinges to a support and held in a storage position by a coil spring. The troughs are disposed over a tray included in the support for catching the pills when the troughs are emptied and guiding the pills to a single outlet at the bottom of the support. For each trough there is a push button that, when actuated, acts against the trough spring to swing the trough back and thereby empty its contents into the tray.

A cover holds the push buttons, which are themselves springloaded so as to return to an unactuated position. Preferably the tray is mounted on the support by a hinge along the side. Markings are provided for indicating the day, and time of day. The push buttons may be illuminated, for example, by small incandescent lamps or light emitting diodes, which illumination may be controlled by a timer so as to signal when medication is to be taken, and an audio signal indicating when medications are to be taken may also be provided to implement these features, a clock may be provided to indicate the times of day and to control these features.

Therefore, it is a principal objective of the present invention to provide a novel and improved pill dispenser.

It is a another objective of the present invention to provide such a pill dispenser that is especially easy for the physically or mentally infirm to use.

It is yet another objective of the present invention to provide a pill dispenser that clearly indicates when predetermined sets of pills ar to be taken.

It is a further objective of the present invention to provide a pill dispenser that organizes the pills in a predetermined order so that the sequence in which they are to be taken is readily determinable.

It is yet a further objective of the present invention to provide a pill dispenser that permits pills to be easily loaded into the dispenser when it is in a horizontal orientation, yet provides for vertical mounting on a wall or stand.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENT

Figures 1, 2:
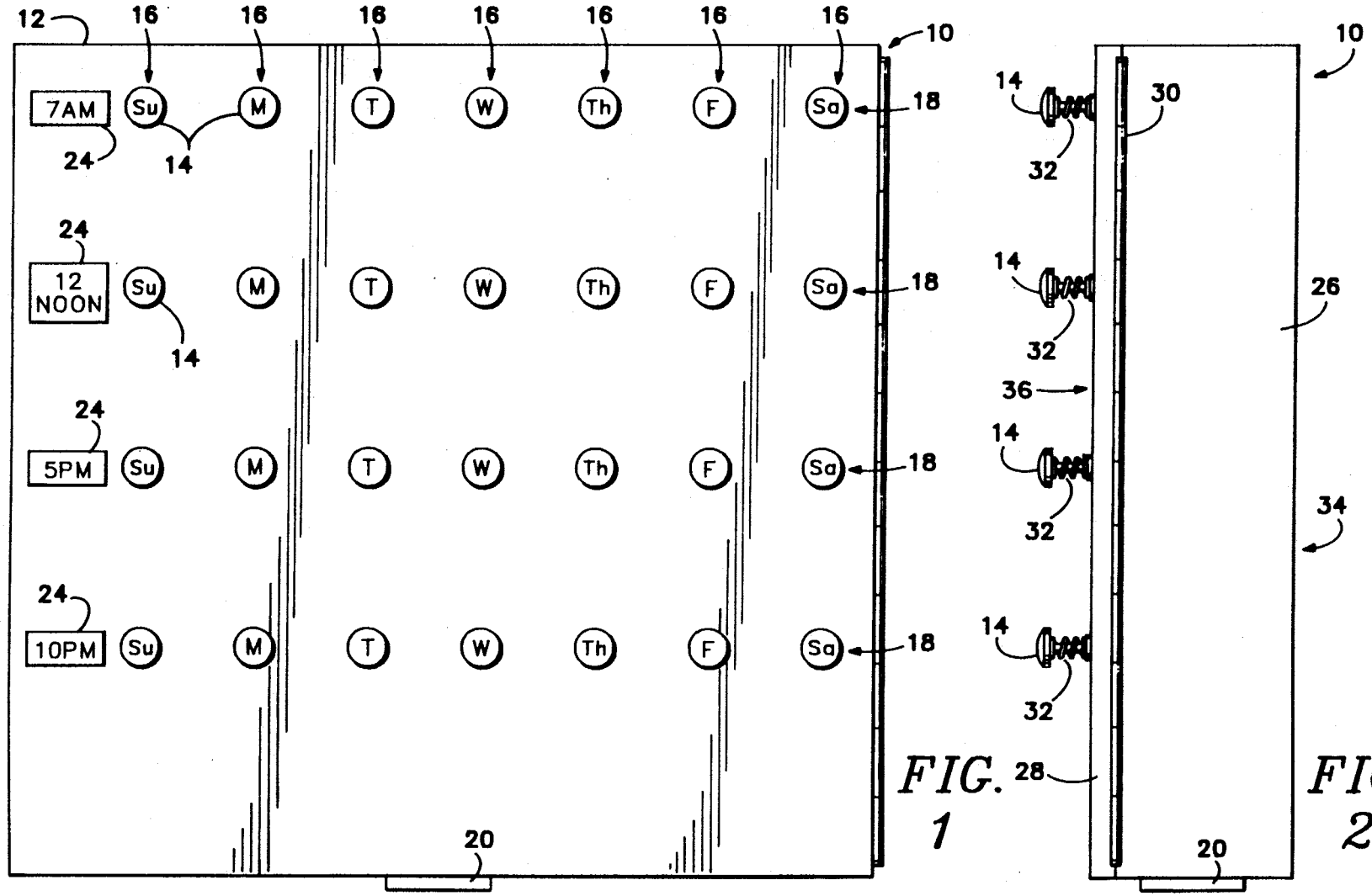
FIG. 1 shows a front view of a pill dispenser according to the present invention.
FIG. 2 shows a side view of the pill dispenser of FIG. 1.

Referring to FIG. 1, a pill dispenser 10 according to the present invention preferably comprises a box 12 having a plurality of push buttons 14 arranged in a matrix by columns 16, corresponding to days, and rows 18, corresponding to times of the day, each push button being actuable to release one or more pills to be taken at the time on the day corresponding to that particular push button. The box is preferably constructed so as to be mounted vertically on a wall or stand so that when a push button is pressed the pills fall by gravity to a single outlet 20 and out that outlet into the user's hand.

Each push button would preferably be marked by one or more letters, e.g., Su, M, T, W, Th, F, and Sa, to indicate the day, as shown in FIG. 1. Similarly, each row 18 would have a corresponding indication as to the time of day which the push buttons in that row should be actuated, as shown at 24. Of course, the symbols could indicate other times and events, such as weeks of the month and days of the week, depending upon the schedule for the medication, and the symbols would preferably be changeable, as by removable stickers.

As shown in FIG. 2, the box preferably has a back portion 26 which holds the pills and provides the outlet 20 and a front cover 28 which is preferably attached to the back portion 26 by a hinge 30, though other attachment means might also be employed without departing from the principles of the invention. The push buttons 14 are preferably provided with coil springs 32, which tend to maintain the push buttons in an unactuated position. Although spring release of the pills may also be provided inside the back portion 26, the springs 32 on the push buttons tend to keep them from moving around loosely so as to cause noise or interfere with loading pills into the box. The front cover 28 is swung open on hinge 30 to load the box with pills, as will become more clear from the description hereafter. Preferably when the box is loaded it is placed with its backside 34 horizontal on a surface, such as a table, with the front side 36 facing upwardly.

Figure 3:
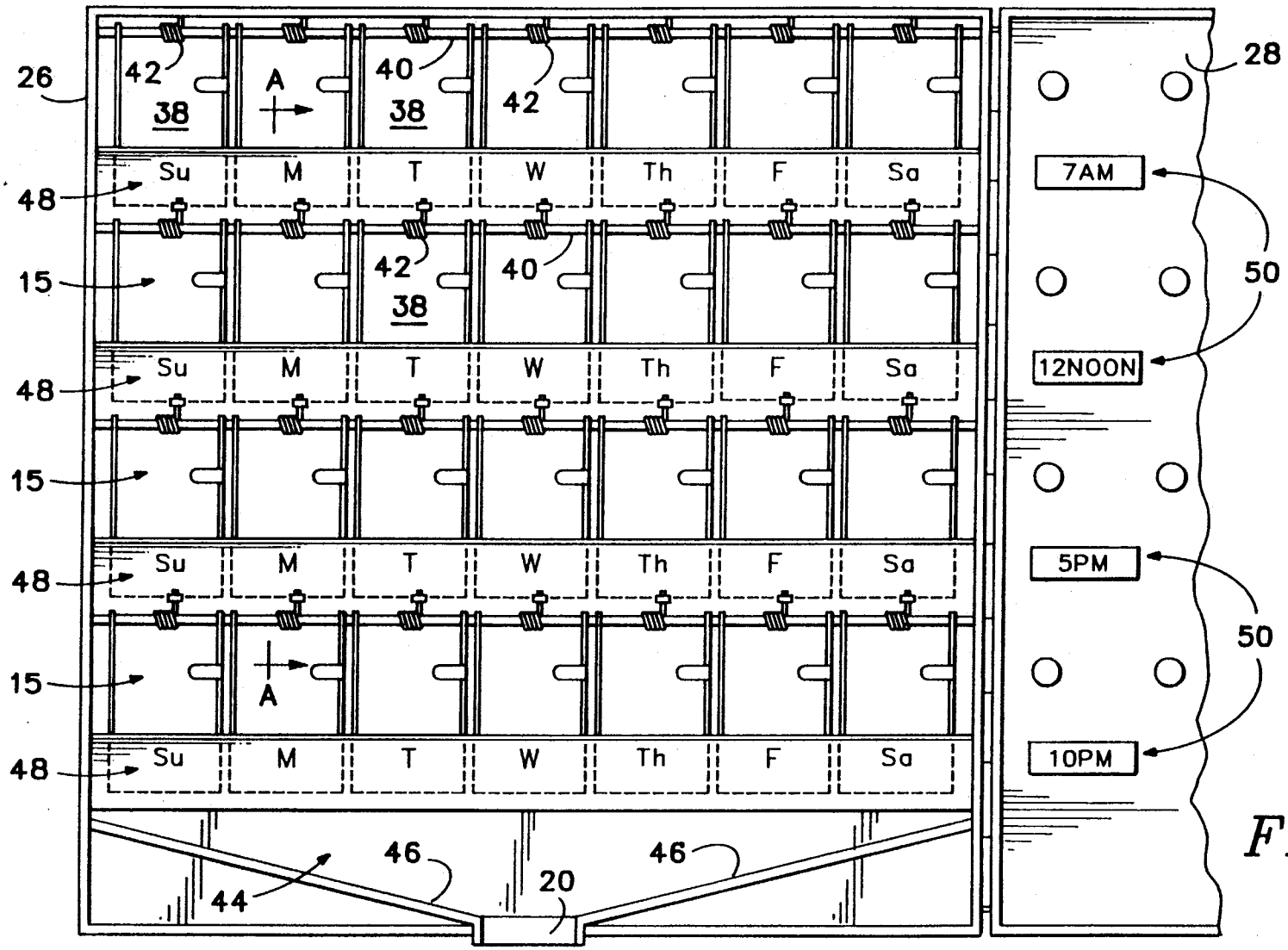
FIG. 3 shows a front view of the pill dispenser of FIG. 1 with the front cover open.

Turning now to FIG. 3, when the cover 28 is swung open, it reveals a plurality of containers 38 arranged in a matrix corresponding to each of the push buttons, each container having an opening toward the front of the box 12, that is, a port 15, for receiving pills 14. These containers, or troughs, are preferably mounted at the top by respective hinges 40 which are loaded by springs 42 so as to maintain the containers in a forward position (or an upward position when the box is on its backside), except when actuated by a corresponding push button. Each container is preferably large enough to hold a plurality of pills. When the corresponding push button is actuated, a container is pushed backward so as to rotate about its hinge and spill its contents into a tray 44. When the box is mounted vertically, the pills fall by gravity to the bottom of the tray which, by virtue of partitions 46, guides the pills to outlet 20. Thence, the back portion 26 acts as a support for the troughs and tray of the device.

Preferably, labels indicating the respective day and time of day are mounted on the inside of the box, as shown at 48 and 50, as well as on the outside.

Figure 4:
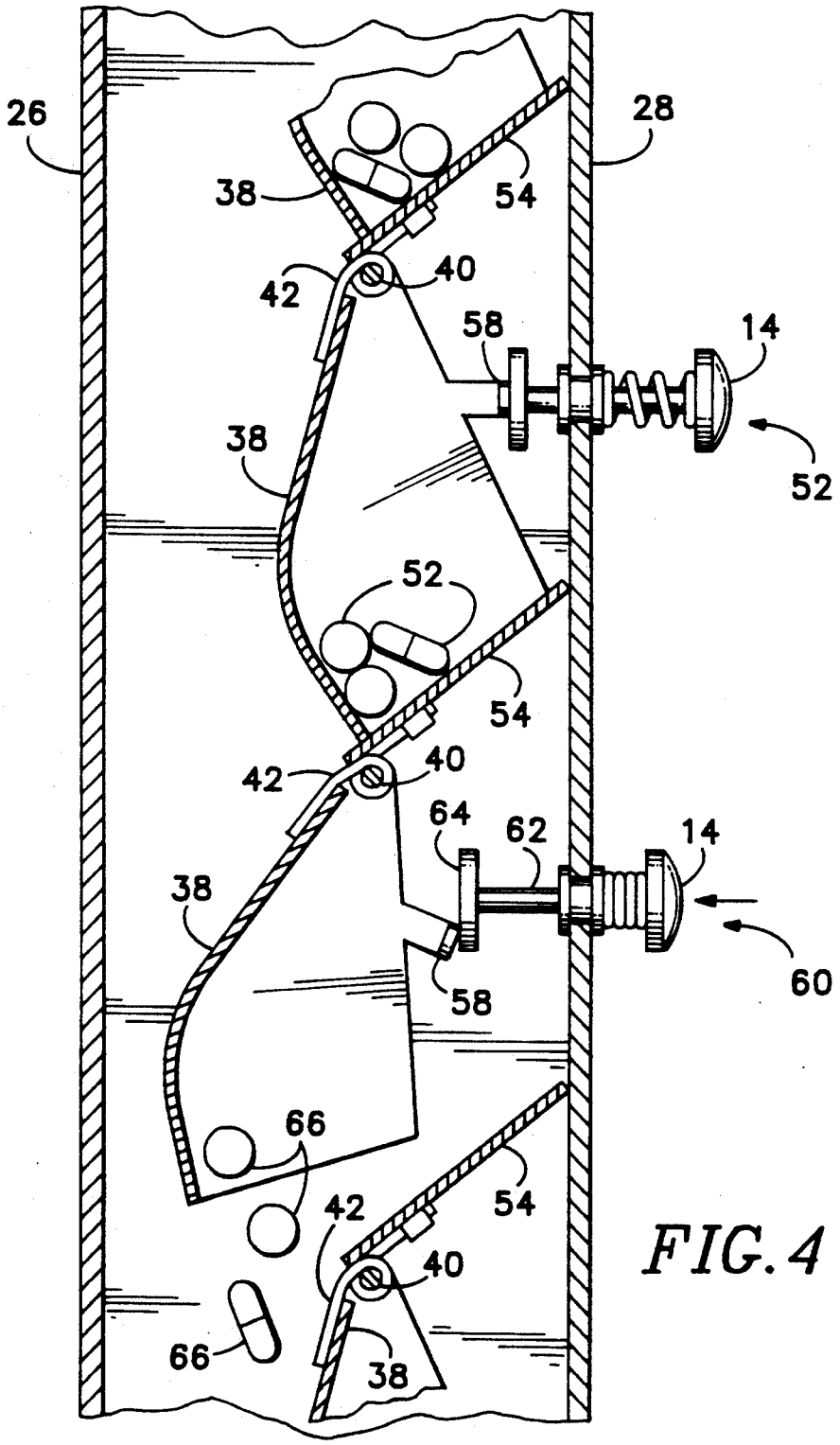
FIG. 4 shows a cross-section of the pill dispenser of FIG. 1 taken along line A—A of FIG. 3.

Operation of the device can be better understood by reference to FIG. 4, which shows a cross-sectional view of the box with the cover closed. The trough 38 corresponding to the push button at location 52 is in its normal, storage position. It can be seen that the trough is held in place by a ramp 54, which forms the bottom of the container, a hinge 40, and a coil spring 42. Several exemplary pills 56 are shown stored in the trough 38. A tab 58 on the trough rests against the inside of the push button 14 located at position 52.

In contrast, the push button located at position 60, just below position 52, has been actuated, i.e., someone has pressed it, thereby moving it inwardly. The push button includes a shaft 62 on the end of which is a disk 64 which presses against the tab 58, thereby pushing the container 38 inwardly and causing it to rotate about hinge 40 against coil spring 42. When that happens, the pills 66 fall out of the container under the force of gravity and are guided by the tray to the outlet 20, not shown in FIG. 4. Once the push button is released, the container 38 returns to its normal position.

It can be seen that, when the box is placed on its backside and the cover is open, each trough 38, together with the corresponding ramp 54 of the next lower trough, provides a receptacle for pills, which are easily loaded into the box. Then, when the cover is closed, the box may be placed in its vertical position and pills are dispensed in a simple fashion by simply pressing the push button for the correct day and time. It is to be understood that the box may be mounted in a vertical orientation by attaching it to a wall or mounting it on a stand of any convenient type as would be readily understood by a person skilled in the art.

Figure 5:
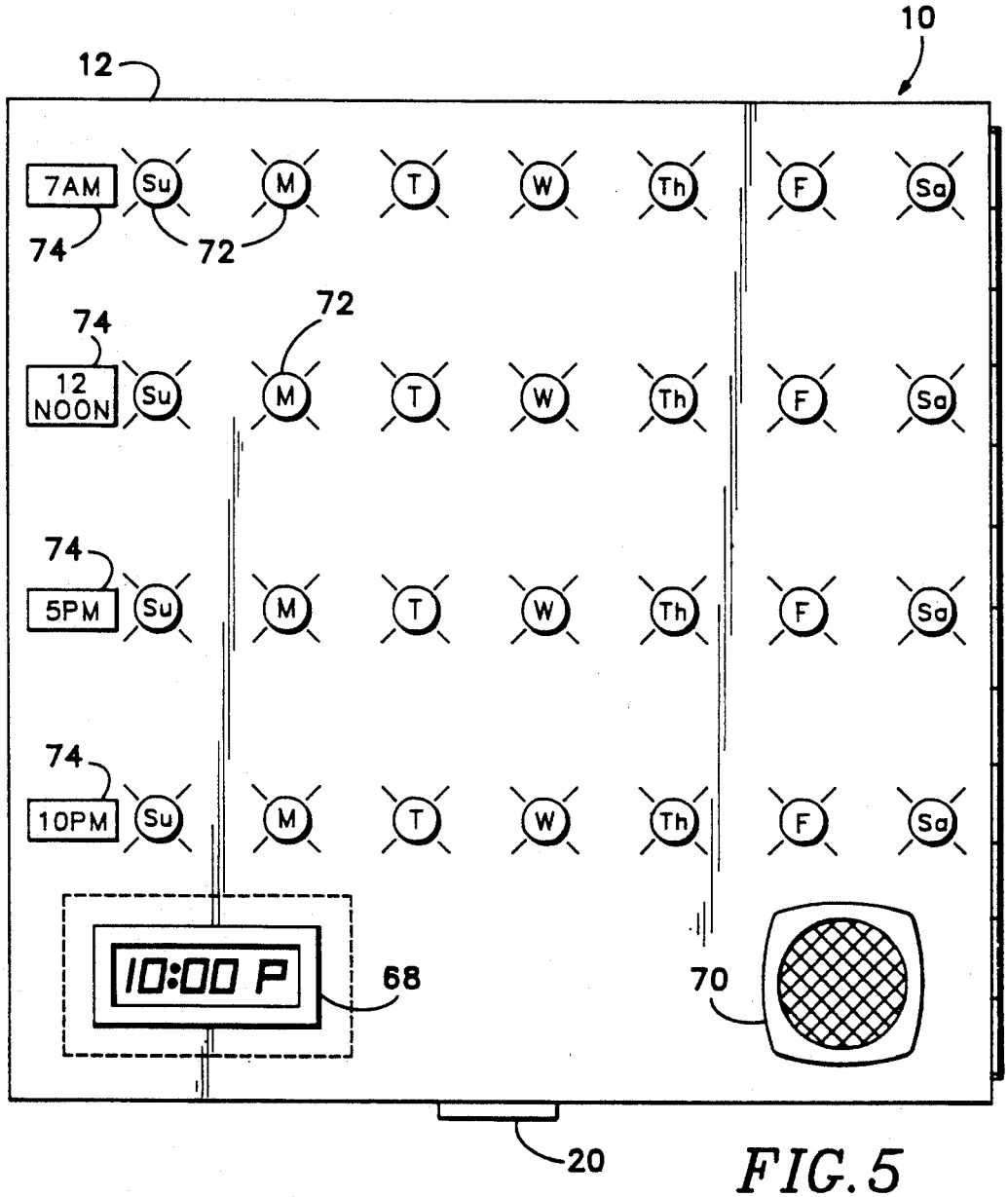
FIG. 5 shows a front view of an alternative embodiment a pill dispenser according to the present invention.

Turning now to FIG. 5, a number of alternative features are shown. First, the dispenser may be provided with a timer, of a variety of commonly known types such as a digital electronic clock, which may also include a clock display 68, such as the commonly known liquid crystal display devices used with wrist watches and other clocks. The timer, or clock, can be employed to actuate an audio transducer 70 to signal the user that it is time to take medication. Similarly, push buttons 72 may be illuminated selectively by the timer so that the push button corresponding to a particular set of pills to be taken is illuminated, while others are not. And, the time of day when the pills are is to be taken may be displayed by fixed labels, as previously described, or by labels that are actually programmable and electronically displayed, as at 74.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

I claim:

1. A device for selectively dispensing pills, comprising:

(a) a plurality of containers, arranged in a matrix, for receiving, fully enclosing, storing, and selectively releasing one or more pills;

(b) guide means, simultaneously associated with a plurality of said containers, for receiving the contents of any of a plurality of said containers and guiding said contents to a common predetermined outlet; and (c) a plurality of actuator means, each associated with a respective container, for selectively causing said respective container to release its contents into said guide means.

2. A device for selectively dispensing pills, comprising:

(a) a plurality of containers, arranged in a matrix, each for receiving, storing, and selectively releasing one or more pills;

(b) support means for mounting said containers, said containers comprising troughs mounted on said support means by respective hinges;

(c) guide means, associated with a plurality of said containers, for receiving the contents of said containers and guiding said contents to a predetermined outlet; and (d) a plurality of actuator means, each associated with a respective container, for selectively causing said respective container to swing on its respective hinge and thereby release its contents into said guide means.

3. A device for selectively dispensing pills, comprising:

(a) a plurality of containers, arranged in a matrix, for receiving, enclosing, storing, and selectively releasing one or more pills;

(b) guide means, simultaneously associated with a plurality of said containers, for receiving the contents of any of a plurality of said containers and guiding said contents to a common predetermined outlet;

(c) support means for mounting said containers, said containers comprising troughs mounted on said support means by respective hinges; and (d) a plurality of actuator means, each associated with a respective container, for selectively causing said respective container to release its contents into said guide means.

4. The device of claim 1, further comprising support means for mounting said containers, said containers comprising troughs mounted on said support means by respective hinges.

5. The device of either of claims 2, 4 or 3, further comprising a plurality of respective first spring means associated with said troughs for urging said troughs toward a receiving and storing position.

6. The device of claim 5, wherein said actuator means provides a force opposing said first spring means for urging said troughs toward a releasing position so as to empty the contents thereof into said guide means.

7. The device of claim 6, wherein said actuator means comprises a plurality of respective push buttons associated with said troughs for selectively moving said troughs.

8. The device of claim 7, wherein said push buttons are offset from said hinges so as to cause said troughs to rotate about their respective hinges when moved by said push buttons.

9. The device of claim 7, further comprising second spring means associated with said push buttons for urging said push buttons away from said troughs.

10. The device of claim 7, wherein said device has a front side and a back side, and said troughs are arranged in rows and columns and have openings toward the front side of said device, said guide means comprising a tray disposed adjacent said troughs opposite said front side of said device for receiving the contents of said troughs when they are urged toward a releasing position, said tray being shaped to guide said contents to said outlet under the force of gravity.

11. The device of claim 10, wherein said support means includes a substantially rectangular prism shaped box and said guide means comprises partitions within said box.

12. The device of claim 11 wherein said box has a top, a bottom, a front, disposed at said front side of said device, and a back, disposed at the back side of said device, and said outlet is disposed at said bottom of said box.

13. The device of claim 12, wherein said box includes markings to identify and distinguish said troughs.

14. The device of claim 13, wherein said markings are arranged to organize one dimension of said troughs into days of the week and another dimension of said troughs into times of day.

15. The device of claim of claim 12, wherein said first spring means has sufficient force to hold said openings of said troughs upwardly when said box is laid on its back in a substantially horizontal position.

16. The device of claim 15, further comprising a cover removably disposed over said front of said box, for covering said openings of said troughs.

17. The device of claim 16, wherein said push buttons are mounted on said cover.

18. The device of claim 16, wherein said cover is mounted on said box by a hinge.

19. The device of claim 16, wherein said cover includes markings to identify and distinguish the push buttons on a predetermined basis.

20. The device of claim 19, wherein said markings are arranged to organize one dimension of said troughs into days of the week and another dimension of said troughs into times of day.

21. The device of claim 2, wherein said support means has a front and a bottom substantially perpendicular to said front, said containers being mounted adjacent said front, and said outlet comprising an aperture in said bottom.

22. A device for selectively dispensing pills, comprising:

(a) a plurality movable of containers, arranged in a matrix, for receiving, storing, and selectively releasing one or more pills, each container having an opening through which pills may be released;

(b) guide means, associated with a plurality of said containers, for receiving the contents of said containers and guiding said contents to a predetermined outlet; and (c) a plurality of push buttons, each associated with a respective container and having means for selectively causing said respective container to move so as to release its contents through said opening into said guide means when the push button is pushed.

23. The device of any of claims 1 or 22, wherein said actuator means comprises a plurality of push buttons associated with respective containers.

24. The device of claim 23, wherein said push buttons are illuminated.

25. The device of claim 24, further comprising timing means for selectively illuminating said push buttons at predetermined times.

26. A device for selectively dispensing pills, comprising:

(a) a plurality of containers, arranged in a matrix, for receiving, storing, and selectively releasing one or more pills;

(b) guide means, associated with a plurality of said containers, for receiving the contents of said containers and guiding said contents to a predetermined outlet;

(c) a plurality of push buttons, each associated with a respective container and having means for selectively causing said respective container to release its contents into said guide means when the push button is pushed; and (d) a front cover disposed in front of said containers in said matrix, said push buttons each having a front surface extending outwardly from said front cover, away from said device, a sufficient amount that said containers may be caused to release their contents by pushing said front surface of said associated push button over a range of position substantially in front of said front cover so that said push button front surface is in front of said front cover in the actuated as well as the unactuated position.

27. The device of any of claims 1, 26 or 22, further comprising timing means and audio signalling means for providing an audio signal at predetermined times.

28. The device of any of claims 1, 26 or 22, further comprising clock means for displaying the current time of day.

29. The device of any of claims 1, 26 or 22, further comprising calendar means for displaying the current day of the year.

30. A device for selectively dispensing pills, comprising:

(a) a plurality of containers, arranged in a matrix, each for receiving, storing, and selectively releasing one or more pills, each said container having a loading port;

(b) guide means, associated with a plurality of said containers, for receiving the contents of said containers and guiding said contents to a predetermined outlet; and (c) a plurality of actuator means, each associated with a respective container, for selectively causing said respective container to release its contents into said guide means, said actuation means being actuable from the same side of said device as said loading ports.

31. A device for selectively dispensing pills, comprising:

(a) a plurality of containers, arranged in a matrix, each for receiving, storing, and selectively releasing a plurality of pills of various shapes;

(b) guide means, associated with a plurality of said containers, for receiving the contents of said containers and guiding said contents to a predetermined outlet; and (c) a plurality of illuminated push buttons, each associated with a respective container, for selectively causing said respective container to release its contents into said guide means.

32. A device for selectively dispensing pills, comprising:

(a) a plurality of containers, arranged in a matrix, for receiving, storing, and selectively releasing one or more pills, each container having an opening through which pills may be released;

(b) guide means, associated with a plurality of said containers, for receiving the contents of said containers and guiding said contents to a predetermined outlet; and (c) a plurality of illuminated push buttons, each associated with a respective container and having means for selectively causing said respective container to move so as to release its contents through said opening into said guide means when the push button is pulsed.

33. A device for selectively dispensing pills, comprising:

(a) a plurality of containers, each for receiving, storing, and selectively releasing one or more pills;

(b) guide means, common to said plurality of containers, for receiving the contents of said containers and guiding said contents to a predetermined outlet;

(c) a plurality of illuminated push buttons, each associated with a respective container, for selectively causing said respective container to release its contents into said guide means; and (d) support means for mounting said containers in matrix rows and columns so that, when said support means is oriented with the matrix extending vertically and said actuator is operated for any one of said plurality of containers, pills in said container fall out of said container into said common guide means under the force of gravity and fall through said common guide means to said predetermined outlet.

34. A device for selectively dispensing pills, comprising:

(a) a plurality of containers, arranged in a matrix, each for receiving, storing, and selectively releasing one or more pills;

(b) guide means, associated with a plurality of said containers, for receiving the contents of said containers and guiding said contents to a predetermined outlet;

(c) a plurality of illuminated push buttons, each associated with a respective container, for selectively causing said respective container to release its contents into said guide means; and (d) support means for mounting said containers, said support means having a front and a bottom substantially perpendicular to said front, said containers being mounted adjacent said front, and said outlet comprising an aperture in said bottom.

35. The device of any of claims 31, 32, 33 or 34, further comprising timing means for selectively illuminating said push buttons at predetermined times.

* * * * *